US005503071A

United States Patent [19]

Hillebrand et al.

[11] Patent Number: 5,503,071

[45] Date of Patent: Apr. 2, 1996

[54] CYLINDER WITH RETRACTABLE POINT SPURS AND SIGNATURE CLAMPS

[75] Inventors: Bernd A. Hillebrand, Bergrheinfeld; Horst B. Michalik, Höchberg, both of Germany

[73] Assignee: Koenig & Bauer Aktiengesellschaft, Wurzburg, Germany

[21] Appl. No.: 353,228

[22] Filed: Dec. 1, 1994

[51] Int. Cl.[6] ..... B41F 1/30

[52] U.S. Cl. ..... 101/409; 101/410; 101/411; 271/277

[58] Field of Search ..... 101/408, 409, 101/410, 411, 412, 232, 240; 270/42, 50; 493/432; 271/277

[56] References Cited

U.S. PATENT DOCUMENTS

| | | | |
|---|---|---|---|
| 1,713,016 | 5/1929 | Zuckerman . | |
| 3,606,308 | 6/1969 | Mowry et al. . | |
| 3,784,187 | 1/1974 | Takayanagi et al. | 270/42 |
| 4,190,242 | 2/1980 | Bolza-Schunemann | 270/50 |
| 4,368,879 | 1/1983 | Hoshi | 493/432 |
| 4,627,754 | 12/1986 | Sholtis et al. | 101/409 |
| 4,892,036 | 1/1990 | Lange | 101/240 |
| 5,078,374 | 1/1992 | Odeau | 270/50 |
| 5,305,993 | 4/1994 | Staeb . | |
| 5,343,806 | 9/1994 | Fricke et al. | 101/410 |

FOREIGN PATENT DOCUMENTS

| | | | |
|---|---|---|---|
| 0167861 | 1/1986 | European Pat. Off. | 101/409 |
| 0515945 | 5/1992 | European Pat. Off. . | |
| 428953 | 9/1911 | France . | |
| 477102 | 6/1929 | Germany . | |
| 536459 | 10/1931 | Germany . | |
| 1074057 | 1/1960 | Germany . | |
| 2030040 | 12/1970 | Germany . | |
| 3226119 | 4/1983 | Germany . | |

*Primary Examiner*—Eugene H. Eickholt
*Attorney, Agent, or Firm*—Jones, Tullar & Cooper

[57] ABSTRACT

A folding cylinder for a web-fed rotary printing press is provided with signature end engaging point spurs. The cylinder is also provided with signature grippers which will engage the signature end or sides so that the point spurs can be retracted at a slower rate of speed to thereby avoid damaging the signature end.

13 Claims, 5 Drawing Sheets

D
1
2
3
4
6
7
8
9
11
12
13
14
16
17
18
21
29
32
37
38
39
42
43
51
52
53
54
55
57
e
g 32
1
1
57
53
54
31
55
52
21
17
14
8
12,13
18
9
11
16
34
56
f
36
37,38
39
B
29
51
2

CYLINDER WITH RETRACTABLE POINT SPURS AND SIGNATURE CLAMPS

FIELD OF THE INVENTION

The present invention is directed generally to a cylinder for a web-fed printing press. More particularly, the present invention is directed to a folding cylinder for a printing press. Most specifically, the present invention is directed to a folding cylinder in a folder of a web-fed printing press. The cylinder is used to convey signatures, which are held along their leading edges by a plurality of point spurs, to a subsequent device for further processing or handling of the signatures. This further processing device is typically a transverse folding device of a web-fed rotary printing press. Signature leading edge and side edge grippers are used, in conjunction with the point spurs, to hold the signatures in place on the cylinder.

DESCRIPTION OF THE PRIOR ART

In web-fed rotary printing presses it is quite conventional to provide one or more folders. These folders typically include cutting cylinders, collect or transfer cylinders and folding blade cylinders. The purpose of such folders is to separate an endless web of printed product into a plurality of signatures which have been cut and cross-folded. One prior art folding apparatus is shown in German Published Examined Patent Application DE-AS 10 74 057. This folding apparatus includes a cutting cylinder, a collecting or transfer cylinder and a flying tuck cylinder. The cutting cylinder carries a plurality of blade strips that cooperate with blade counter strips on the collecting or transfer cylinder. A leading edge of the endless paper train is connected to the surface of the collecting or transfer cylinder by a plurality of controllable point spurs. These point spurs hold the leading edge of the web during cutting of the web into signatures. Once the cutting has been accomplished, the signatures or a collected group of signatures are transferred to similar point spurs on the surface of the folding blade cylinder. The folding blade cylinder typically has two diametrically oppositely located folding blades. These folding blades are forcibly extended and retracted by their spindles during rotation of the folding blade cylinder and press the signatures between two folding rollers. This is the conventional way to create a transverse fold in a signature.

The point spurs which, as viewed in the direction of web travel, have been punched through the leading edge of the signatures, must be rapidly retracted below the surface of the folding cylinder prior to transfer of the signature to the transverse folding device. The point spurs must be retracted at the correct time and in an expeditious manner to allow the signatures to be transferred without damage. Problems are apt to occur with rapidly moving flying tuck cylinders in that after releasing the signatures, the point spurs must be actually "jerkily" controlled and operated by means of control rollers and control cams. This operation requires large acceleration forces since, in some instances, it is necessary to retract the point spurs up to 12 mm. If the retraction speed of the point spurs is too slow, the holes formed by the point spurs in the leading edges of the signatures will rip and will become elongated slits. The signatures located in the vicinity of the folding cylinder surface; i.e. the signatures closest to the surface of the cylinder are most affected by this problem and are apt to have their leading edges formed with elongated slits instead of points of perforation. The formation of these slits in the leading edges of the signatures, because of too slow retraction of the point spurs, can also result in an uneven formation of the transverse folds formed in the signatures.

In another prior art device, as shown in German Patent DE-DS 536 459 there is disclosed a cylinder-shaped transverse cutting and collecting device for use in a web-fed rotary printing press which operates without point spurs. In this device the cylinder has several pairs of lateral grippers which are used to grasp and forward cut sheets. However, only single sheets can be conveyed or transferred and at only moderate speeds by this prior art device. If the speed of this device were to be increased, the accuracy of the signatures during transfer between the cylinders could not be maintained.

It will thus be seen that a need exists for a cylinder which will operate at high speeds, which will not damage the leading edges of the signatures and which will maintain the accuracy of the signatures during transfer. The cylinder in accordance with the present invention provides such a device and is a significant improvement over the prior art devices.

SUMMARY OF THE INVENTION

It is an object of the present invention to provide a cylinder for a web-fed printing press.

Another object of the present invention is to provide a folding cylinder in a web-fed press.

A further object of the present invention is to provide a folding cylinder in a folder of a web-fed printing press.

Still another object of the present invention is to provide a cylinder for conveying signatures.

Yet a further object of the present invention is to provide a folding cylinder which utilizes point spurs and grippers.

Even still another object of the present invention is to provide a folding cylinder which allows the point spurs used to hold the signature leading edge to be retracted early.

Yet even a further object of the present invention is to provide a folding cylinder which allows the point spurs to be retracted before the signatures are transferred at production speed to a subsequent processing device, such as a folder.

As will be discussed in detail in the description of the preferred embodiments which is presented subsequently, the cylinder in accordance with the present invention, which is preferably a folding cylinder used for conveying signatures which are held along their leading edges by point spurs, conveys the signatures to a further processing device, such as a transverse folding device in a web-fed rotary printing press. The cylinder is provided with a plurality of controllable clamping or gripping devices. These clamping devices can act either on the leading edge of the signatures, the longitudinal side edges of the signatures or on both. These clamping devices clamp the signatures to the jacket surface of the cylinder and allow the point spurs to be retracted at a slower rate of speed and thus prevent the formation of elongated slits in the leading edges of the signatures. These clamping grippers are operated by double arm levers with first arms being engageable with control cams and with second arms being connected through couplers, rocker bearings and rockers to the clamping grippers. These grippers are thus shiftable with rotation of the conveying cylinder.

The cylinder in accordance with the present invention has a number of advantages with respect to the prior art devices. The clamping grippers of the present invention are effective in maintaining the leading edges of the signatures on the jacket surface of the cylinder, which may be, for example, a folding cylinder. This allows the retraction of the point spurs to begin as soon as the grippers have come into seated engagement with the outer surface of the signatures. It is also quite possible to immediately seat the grippers on the signatures following the cutting of the web into the signatures and before passing by the folding rollers. So long as the grippers do not collide with the folding rollers while passing them, they can be brought into contact with the signatures on the cylinder. Between the time that the grippers in accordance with the present invention contact the signatures, and a subsequent time at which the leading edge of the signatures are moved in an opposing direction; i.e. in the draw-in direction of the pair of folding rollers, there is sufficient time to fully retract the point spurs safely out of the signatures. In this way, the time for retraction of the point spurs has been tripled as compared to the time afforded by the prior art devices. During the retraction of the leading edges of the signatures in the second or opposing direction, as was discussed above, it is necessary to raise the grippers which engage the leading edges of the signatures, only a very slight amount. This lifting movement of only several tenths of a millimeter, is sufficient to release the cut printed products or signatures. The slower retraction of the point spurs, which is afforded by the present invention, prevents any permanent deformation or tearing of the signatures in the area of the point spur holes. This allows the production equipment to work at the highest possible speeds without tearing the point spur holes and thereby prevents the formation of elongated slits in the leading edges of the signatures.

In the cylinder in accordance with the present invention, it is particularly advantageous to provide several grippers along not only the signature leading edges but also at half the length of the signatures and in the area of their base edges. These grippers are usable for holding the long sides of the long signatures, many of which are often placed on top of each other. This provision of additional grippers prevents fluttering of the long signatures which is apt to occur as the conveying cylinders are rotated at high rates of speed. If the grippers are disposed laterally to the sides of the signatures placed on the surface of the conveying cylinder, sufficient space remains for the various units, such as folding blade cylinders, point spurs and the like.

In one embodiment of the cylinder in accordance with the present invention, the grippers may be structured to grip and cover the entire leading or front edge of the signatures carried on the cylinder. The force of the air, which is a function of the rotational speed of the cylinder, acts on the leading edges of the cylinders. In the prior art devices these air forces have resulted in a partial lifting of the signatures off of the jacket surface of the folding or conveying cylinder and in a fluttering of these front or leading edges. Such a fluttering may have a harmful effect on the signatures. By use of the present invention this harmful effect has been eliminated. The folded products thus show excellent quality with respect to the formation of the transverse fold, as well as the point spur holes.

The cylinder in accordance with the present invention, which can be used as a conveying, folding or signature collecting cylinder, overcomes the limitations of the prior art devices. It forms a substantial advance in the art.

BRIEF DESCRIPTION OF THE DRAWINGS

While the novel features of the cylinder in accordance with the present invention are set forth with particularity in the appended claims, a full and complete understanding of the invention may be had by referring to the detailed description of the preferred embodiments which is set forth subsequently, and as illustrated in the accompanying drawings, in which:

DETAILED DESCRIPTION OF THE PREFERRED EMBODIMENTS

Figure 1:
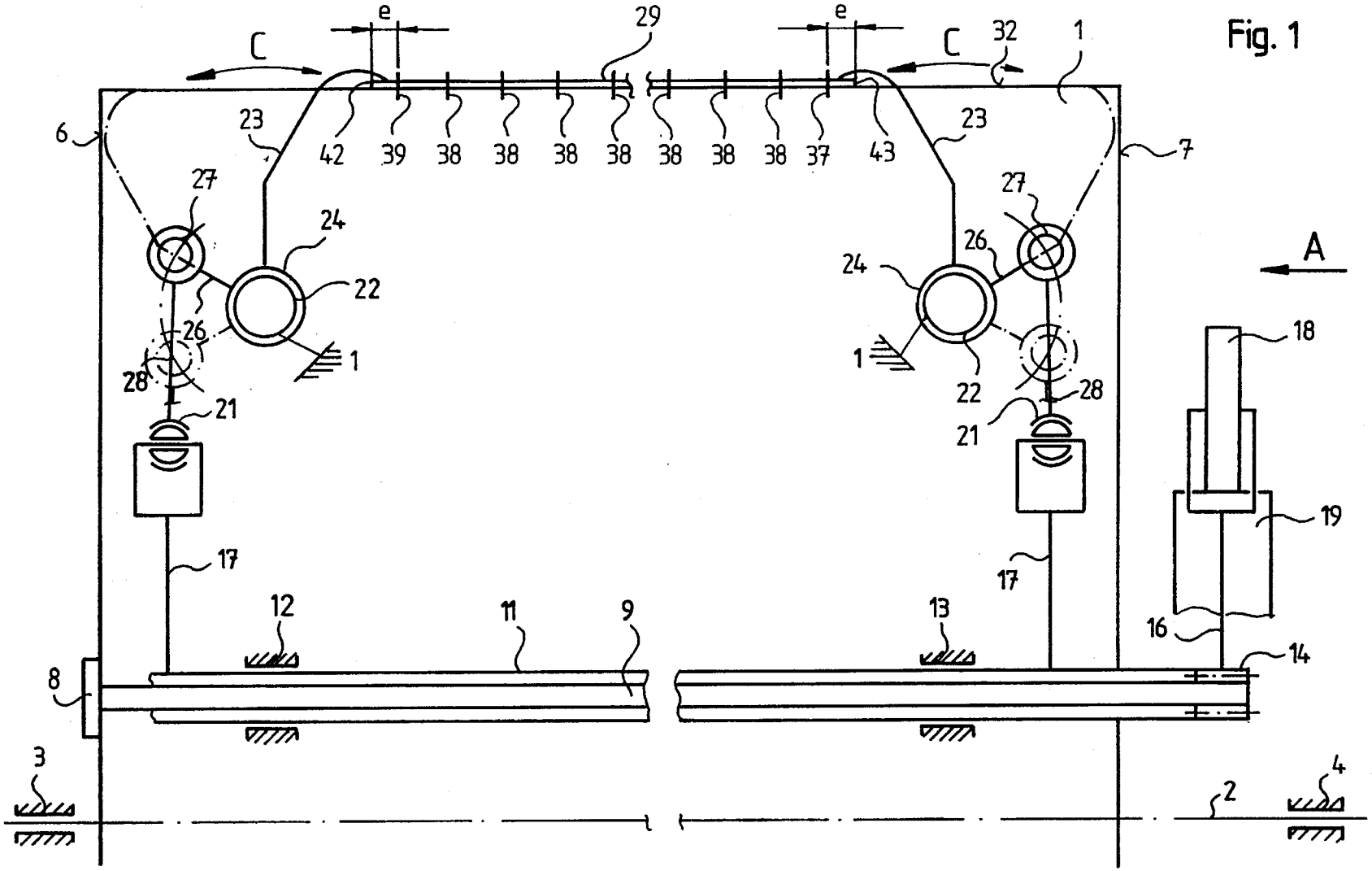
FIG. 1 is a schematic longitudinal section view of a first preferred embodiment of a portion of a folding cylinder in accordance with the present invention, and showing the side grippers in an operating or gripping position.
Figure 2:
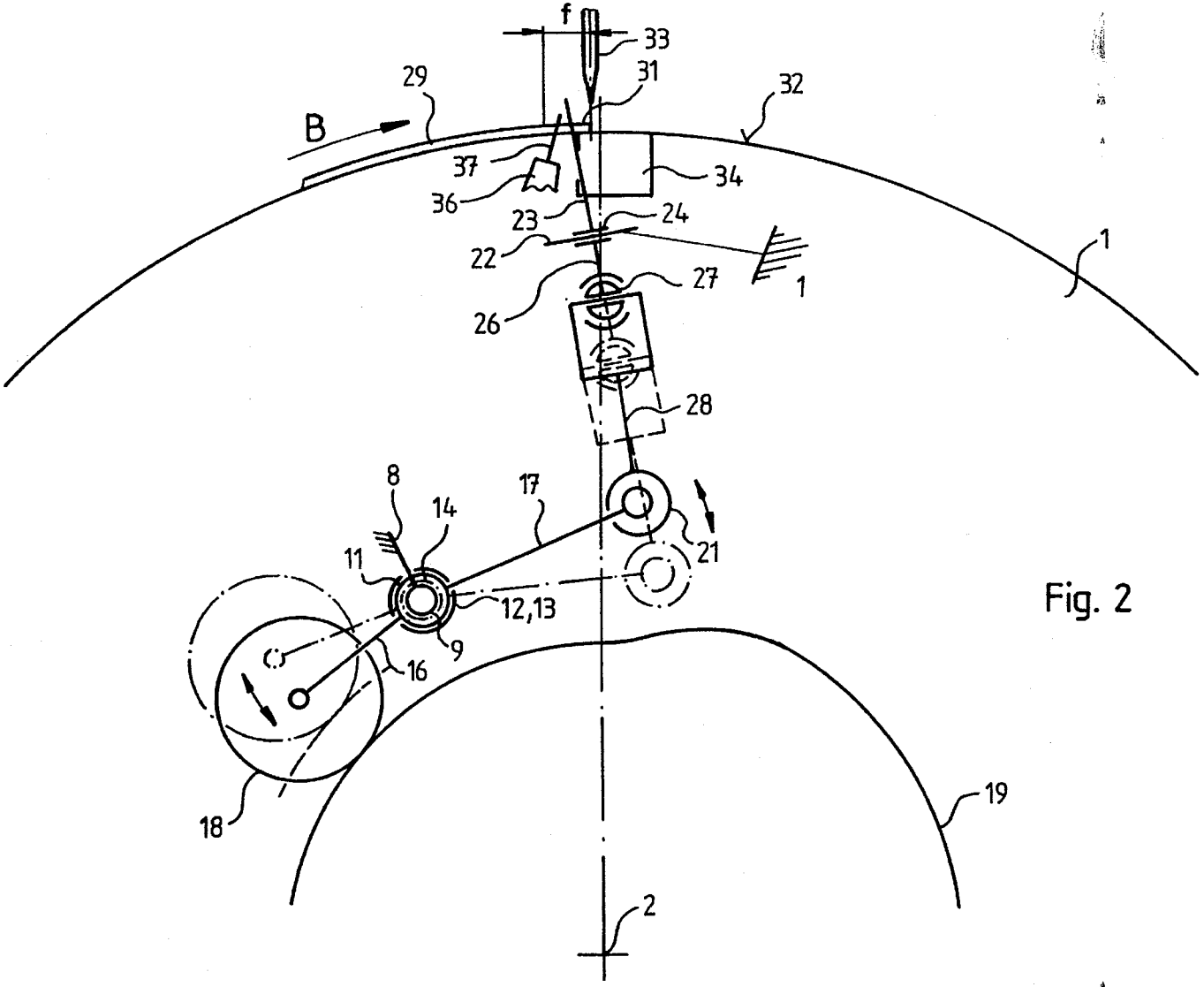
FIG. 2 is an end view of the cylinder of FIG. 1 and taken in the direction indicated by arrow A in FIG. 1.

Referring initially to FIG. 1, and taken in conjunction with FIG. 2, there may be seen generally at 1 a first preferred embodiment of a folding cylinder in accordance with the present invention. It will be understood that folding cylinder 1 is a part of a folder assembly in a web-fed rotary printing press of generally conventional construction and operation. The folding cylinder 1 is typically used in a folder assembly to receive a leading edge of a printed web. The web is then cross cut by a cutting blade cylinder which cooperates with the folding cylinder 1. Once the web has been cross cut, a folding blade extends radially outwardly from the interior of the folding cylinder and inserts the center of the now severed web or signature between a pair of folding rollers to form a transverse fold. The folding cylinder 1 can be operated in either straight or collect run productions. This structure and operation of the folding cylinder 1 and its use and location within a generally well known web-fed rotary printing machine is all generally known and does not form part of the present invention.

The folding cylinder 1 is supported for rotation around its axis of rotation 2 by means of axle journals, not specifically shown, in schematically depicted side frames 3 and 4 of a web-fed rotary printing press. The folding cylinder 1 has laterally spaced end disks 6 and 7, which are connected to each other by suitable cross arms or device supports, not shown, extending in the axial direction. A torsion bar holder 8 is securely disposed on the first end disk 6 of the folding cylinder. A first end of a torsion bar 9, which extends in the axial direction and projects through the second end disk 7, is clamped in torsion bar holder 8. The torsion bar 9 is coaxially surrounded by a pipe-shaped control spindle 11, which is rotatably seated in spaced bearings 12 and 13 that are fixed on the folding cylinder. The second ends of the torsion bar 9 and the control spindle 11 are located outside of the folding cylinder 1 and project through the second end disk 7. These second ends are frictionally and interlockingly connected with each other, for example by means of teeth 14.

As may be seen in FIGS. 1 and 2, a first arm 16 and a second arm 17 of a two-armed lever pair 16, 17 are connected through their respective first ends with the control spindle 11 to form a bearing. On its second end, the first arm 16 supports a control roller 18 which, as a result of the rotating movement of the folding cylinder 1, runs on a control cam 19 that is fixed on the side frame. The depiction of the first arm 16 in FIG. 2 is 180° displaced from that shown in FIG. 1 for ease of illustration.

The second arm 17, fastened by its first end on the control spindle 11, is frictionally and interlockingly connected at its second end with a rocker bearing 21. A gripper 23, which is pivotable transversely to the direction of rotation B of the folding cylinder 1, is connected through a gripper support 24 with a rocker 26, which is, in turn, connected by a rocker bearing 27 of a coupler 28 with the first rocker bearing 21 located at the second end of the arm 17. As may be seen most clearly in FIG. 2, this gripper 23, which will herein after be referred to as a side gripper, is engageable with a side or longitudinal edge of a signature 29 which is positioned on a jacket surface 32 of the folding cylinder 1.

A similar, second arm 17 is securely attached to the control spindle 11 inside the folding cylinder 1 and in the vicinity of the first end disk 6. This second arm 17 utilizes the elements 21, 22, 24, 26, 27, 28 which correspond to similar elements previously discussed, to synchronously activate a second side gripper, also indicated by 23. Both of these side grippers 23 can be moved transversely to the direction of rotation B of the folding cylinder toward or away from each other in the direction of the arrow C, due to the rotation of the control spindle 11 caused by the control roller 18 riding on the control cam 19, so that the side grippers 23 laterally press signatures 29, in the vicinity of their front or leading edges 31, against the jacket surface 32 of the folding cylinder 1.

Figure 4:
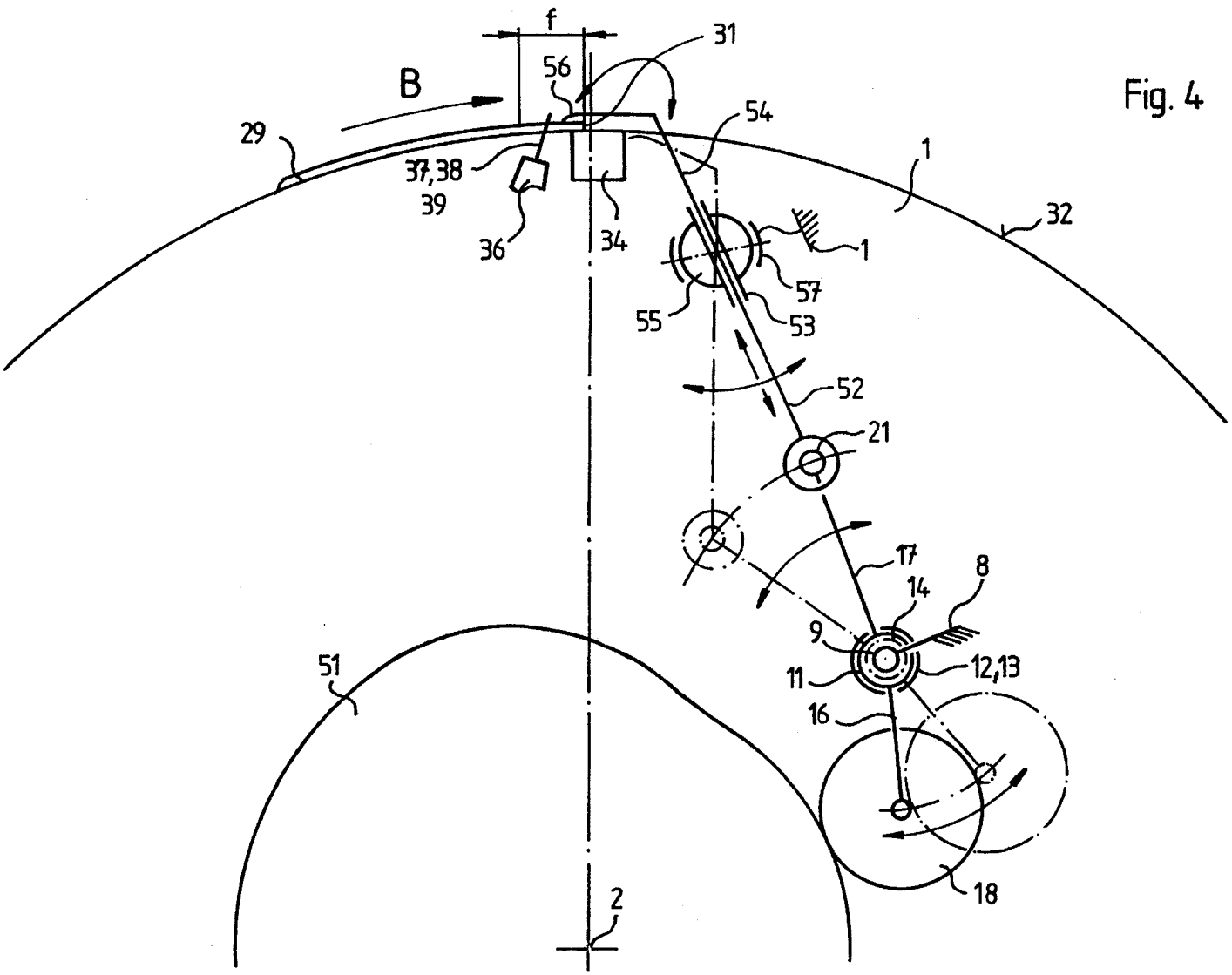
FIG. 4 is an end view of the cylinder of FIG. 3 and taken in the direction indicated by arrow D in FIG. 3.

A schematically depicted cutting blade, identified by 33, of a cutting cylinder, not shown, separates the signatures 29 against a blade counter strip 34 carried by the folding cylinder 1. A row of point spur holders 36 which are schematically represented in FIGS. 2 and 4, are disposed in a frictionally connected and interlocking manner on a spindle, not shown, that is, in turn, fixedly seated on the folding cylinder, at a defined distance, for example of 40 mm, and support points 37, 38 and 39. In a known manner, the point spur spindle is pivoted against the force of a restoring spring, not shown, on a control cam fixed on the frame by way of a lever arm, not shown, having a control roller. The above-described control and operation of the point spurs 37, 38 and 39 is disclosed in the German Published, Examined Patent Application DE-AS 10 74 057 which was previously mentioned. While the side grippers 23 hold the signature 29 only on their long or longitudinal sides 42, 43 in the vicinity of their front edges 31, a number of points 37, 38 and 39 are disposed in a point spur row, so that the front edges 31 of the signatures 29 can be exactly positioned on the folding cylinder 1 at the time of lateral cutting of the signatures 29. As may be seen in FIG. 1, a number of center points 38 are disposed between two outer points 37 and 39.

After the front edge 31 of the product train has been fixed on the points and the signatures 29 have been transversely cut, the grippers 23 are moved from their rest position, as shown by dashed lines in FIG. 1, into their holding or operating position, as shown in solid lines, so that the signatures 29 are firmly held on the jacket surface 32 of the folding cylinder 1. Subsequently, the points 37, 38, 39 can be retracted out of the signatures 29. The positions of the operating elements, such as control roller 18 and rocker bearing 21, as shown in dot-dash lines in FIGS. 1 and 2, represents the rest position of the side grippers 23. In this position, the side grippers 23 are in the rest position, in which they are pivoted away from the signatures 29 and below the jacket surface 32 of the folding cylinder 1. Depending on the requirements of the particular printing press, it is possible to dispose three, five or seven sets of equal units, such as point spur rows, blade counter strips and pairs of side grippers 23 on the cylinder 1. It is also possible to arrange the grippers of the invention on folding blade cylinders equipped with point spurs in order to pass on the signatures held by the points rapidly and exactly to a folding jaw cylinder.

Figure 3:
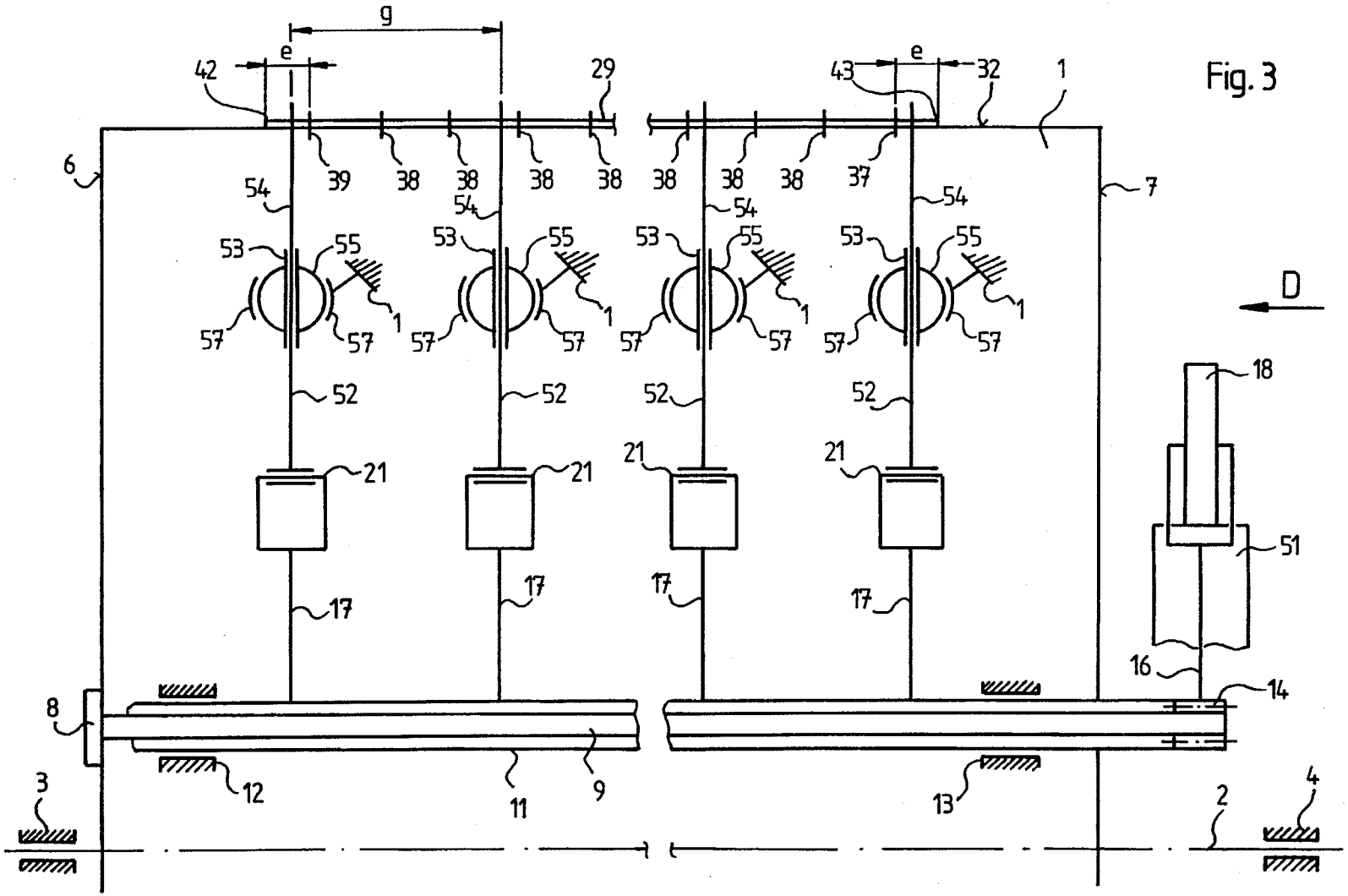
FIG. 3 is a schematic longitudinal sectional view of a portion of a second preferred embodiment of a folding cylinder and showing a plurality of leading edge grippers in a gripping position.

A second preferred embodiment of a folding cylinder of a folding apparatus in accordance with the present invention is shown in FIGS. 3 and 4. The folding cylinder 1 is supported for rotation around its axis of rotation 2 by means of axle journals, not specifically shown, in schematically depicted side frames 3 and 4 of a web-fed rotary printing press. The folding cylinder 1 has laterally spaced end disks 6 and 7, which are connected to each other by suitable cross arms or device supports, not shown, extending in the axial direction. A torsion bar holder 8 is securely disposed on the first end disk 6 of the folding cylinder. A first end of a torsion bar 9, which extends in the axial direction and projects through the second end disk 7, is clamped in torsion bar holder 8. The torsion bar 9 is coaxially surrounded by a pipe-shaped control spindle 11, which is rotatably seated in spaced bearings 12 and 13 that are fixed on the folding cylinder. The second ends of the torsion bar 9 and the control spindle 11 are located outside of the folding cylinder 1 and project through the second end disk 7. These second ends are frictionally and interlockingly connected with each other, for example by means of teeth 14.

As may be seen in FIGS. 3 and 4, a first arm 16 and a second arm 17 of a two-armed lever pair 16, 17 are connected through their respective first ends with the control spindle 11 to form a bearing. On its second end, the first arm 16 supports a control roller 18 which, as a result of the rotating movement of the folding cylinder 1, runs on a control cam 51 that is fixed on the side frame. In comparison with the representation in FIG. 4, the arm 16 is shown displaced by 180° in FIG. 3. The second arm 17 which is fastened by its first end on the control spindle 11, is frictionally and interlockingly connected at its second end with a rocker bearing 21. A push rod 52 is also connected at its inner end with the rocker bearing 21, and is seated in a pivotable linear guide 53. At its outer end, push rod 52 receives a signature end gripper 54 with a gripper tip 56 on its radial outer end. The linear guide 53 can be embodied as a ball-and-socket joint 55 and can be pivotably seated with the jacket surface of the ball in two bearing shells 57 which are fixed on the folding cylinder, and which form the socket. Linear guide 53 can have a bore for receiving the push rod 52 at right angles to its axis of rotation. It is also possible to employ a roller with a bearing shell in place of a ball-and-socket joint 55.

As shown in FIG. 3, several signature end grippers 54, for example four such signature end grippers 54, can be located next to each other over the entire axial width of the folding cylinder 1 and can be operatively connected, such as by clamping, through the various elements 53, 55, 52, 21 and 17, as discussed above, with the control spindle 11. Because of the movement of the control roller 18 on the control cam 51, the arm 17 of the two-armed lever 16, 17 also performs a pivot movement, which is transmitted to the push rod 52 that is pivotably connected with the arm 17. Since the push rod 52 is guided in the pivotable linear guide 53, the push rod 52 is subjected to a combined tilting and lifting movement, so that the signature end gripper 54 that is disposed at the end of the push rod 52 describes an ellipse-like curve. After having traversed the ellipse-like curve, the signature end gripper 54 deposits its gripper tip 56 from above on the front edge 31 of the signatures 29 next to one of the points 37, 38, 39 and in this way presses the signatures 29 against the jacket surface 32 of the folding cylinder 1. The points 37, 38, 39 can now therefore be retracted into the folding cylinder 1 prior to the transfer of the signatures 29 to a transverse folding device. The release of the signatures 29 by the grippers 54, which are disposed next to each other in the axial direction, is executed by a minimal lifting movement of the grippers 54 to a lifting height of a few tenths of a millimeter. The grippers 54 are represented in their two end positions as may be seen in FIG. 4. The grippers 54 are shown by dash-dotted lines in their position of rest and by solid lines in their holding or operating position. It can be seen from FIG. 4 in particular that in the position of rest, the grippers 54 have been retracted below the jacket surface 32 of the folding cylinder 1. The points 37, 38 and 39 are schematically depicted in FIGS. 3 and 4 and are spaced apart by a distance "e". These points 37, 38 and 39 are provided with a known drive mechanism by point spur holders 36, as disclosed in German Published, Examined Patent Application DE-AS 10 74 057.

Referring again to FIG. 4, a strip-shaped area at the front edge 31 of the signature 29 is indicated by "f". This strip "f" extends parallel to the front edge 31 of the signature 29. It is in this area of strip "f" in which the gripper tips 56 press the signatures 29 against the jacket surface 32 of the folding cylinder in the vicinity of the points 37, 38 and 39. Furthermore, as may be seen in FIG. 3, the signature end grippers 54 are arranged at a distance "g" with respect to each other in this area "f", wherein the tips 56, not shown in FIG. 3, of the signature end grippers 54 press on the signatures 29 in the vicinity of the points 37, 38 and 39. The axially located outer grippers 54, which are disposed in the vicinity of the end disks 6 and 7 of the folding cylinder 1, are located in an area between a long or longitudinal side 42 or 43 of the signatures 29 and an outer point 39, 37 with a maximum distance "e". The front edge 31 of the signatures rests on the blade counter strip 34 which extends in the axial direction across folding cylinder 1.

Figure 5:
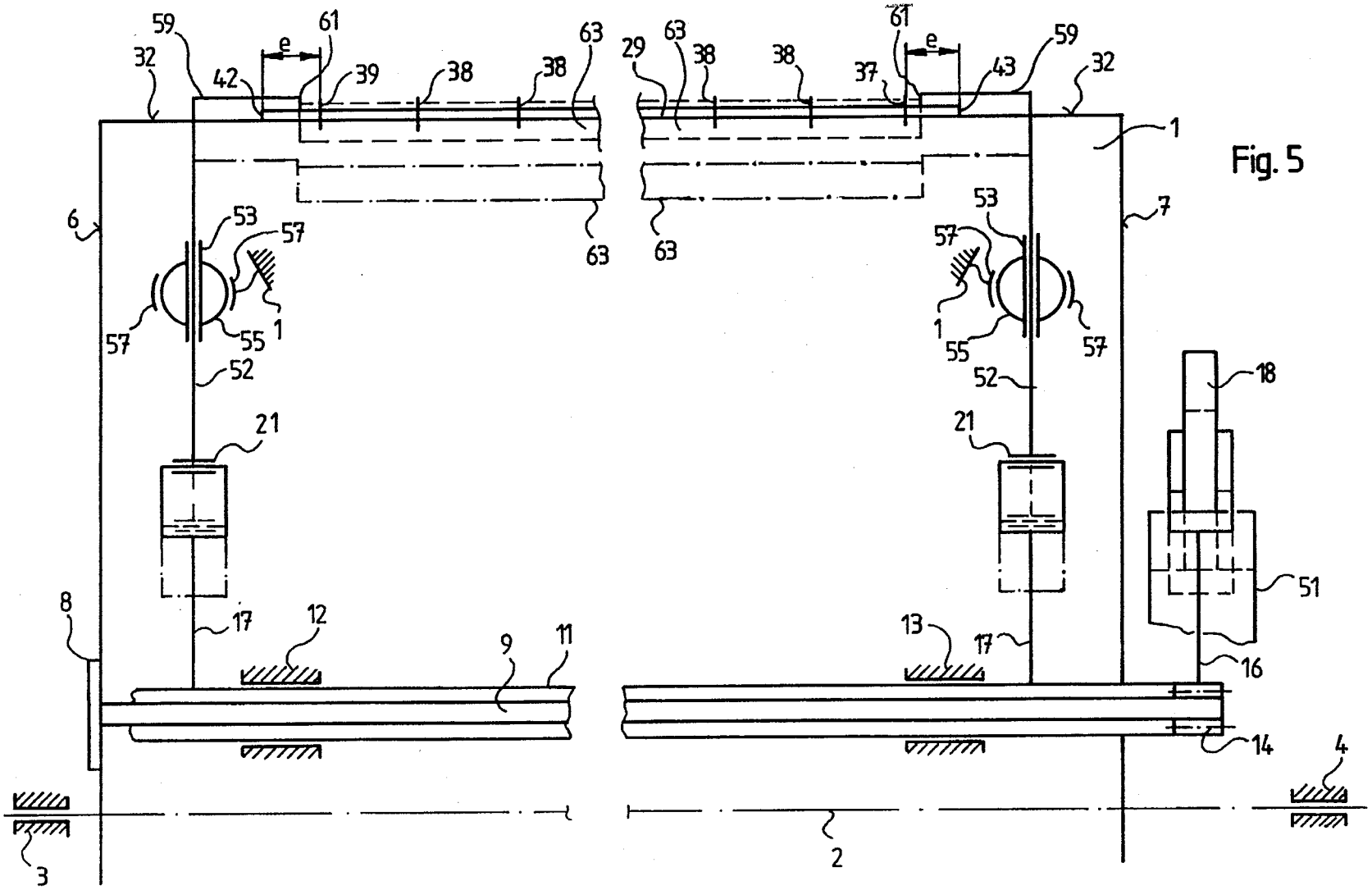
FIG. 5 is a schematic longitudinal sectional view of a portion of a folding cylinder in accordance with third and fourth embodiments of the present invention and showing side L-shaped grippers and a leading edge gripper strip, respectively.

In a third preferred embodiment of a folding cylinder 1 for a folding apparatus in accordance with the invention, as seen in FIG. 5, the feature of the invention which is in contrast to the second preferred embodiment of FIGS. 3 and 4 is that a side gripper 59 which is actuated by the drive mechanism 17, 21, 52, 53, as described in connection with of FIGS. 3 and 4, is provided with a gripper tip 61. This drive mechanism 17, 21, 52, 53 for side gripper 59 is disposed between the long or longitudinal sides 42 and 43 of the signatures 29 and the end disks 6 and 7 of the folding cylinder 1. This drive mechanism, having the arm 17 on the control spindle 11, moves, as described in FIGS. 3 and 4, in such a way that the gripper tips 61 describe an ellipse-like curve and are deposited from above next to the outer points 37, 39 on the signatures 29. In contrast to the grippers 54 of FIGS. 3 and 4, the grippers 59 are L-shaped. With their gripper tips 61, the grippers 59 are deposited in the strip-shaped area "f", which is shown in FIG. 4, of the signatures 29 in the vicinity of the outer points 37, 39 as well as in an area of a length "e" that is located in an axial direction between the long or longitudinal sides 42 and 43 of the signatures 29 and the outer points 37, 38.

In accordance with a fourth preferred embodiment which is also shown in FIG. 5, side grippers 59 are provided, and between whose gripper tips 61 a gripper strip 63 is disposed. The gripper strip 63 extends in the axial direction 2 along the entire front edge 31 of the signatures 29 and can have an L-shaped profile, such as is shown in FIG. 5 in dashed lines in its operating position and in dot-dash lines in its rest position. It is possible to provide two or more than two drive mechanisms for operating this gripper strip 63, with these drive mechanisms connected by means of the arm 17 with a control spindle 11. The advantage of this gripper strip 63 lies in that the signatures 29 are completely covered along their front edges 31 during the movement of the folding cylinder 1 in the direction of rotation B, so that the force of air cannot cause lifting or fluttering of the signatures 29.

It is practical, in the case of multiple numbers of long signatures 29 disposed on top of each other, to provide several side grippers 23 or 59 behind each other along the long or longitudinal sides 42 and 43 of the signatures in order to prevent "fluttering" of the signatures 29 because of the effects of air. It is then necessary to provide several controls and drive mechanisms for these side grippers 23 or 59.

It is also possible to extend the gripper strip 63 as far as above the points 37, 38, 39 and to provide apertures on the places of the gripper strip 63 where the points 37, 38, 39 extend through the signature 29. In this way the strip-shaped area "f" of the signature 29 fixed on the points is covered by the gripper strip 63.

While preferred embodiments of a folding cylinder in accordance with the present invention have been set forth fully and completely hereinabove, it will be apparent to one of skill in the art that a number of changes in, for example the overall size of the cylinder, the drive assembly for the cylinder, the drives for the associated cylinders and the like may be made without departing from the true spirit and scope of the present invention which is accordingly to be limited only by the following claims.

What is claimed is:

1. A cylinder such as a folding cylinder usable to convey signatures to a subsequent device such as a transverse folding device in a web-feb rotary printing press, said cylinder comprising:

a cylinder body having an outer jacket surface and an axis of rotation;

a plurality of controllable and retractable point spurs usable to engage and to secure a leading edge of a signature to said jacket surface; and controllable clamping devices acting in conjunction with said point spurs and engaging said signatures on a strip shaped area at a leading edge surface of said signatures to clamp said signatures to said jacket surface of said cylinder, said clamping devices engaging said signatures while said signatures are engaged by said point spurs and continuing to engage said signatures during the time when said point spurs are retracted, said clamping devices continuing to secure said signatures to said jacket surface after retraction of said point spurs.

2. The cylinder of claim 1 wherein said clamping devices are controllable grippers.

3. The cylinder of claim 2 including a plurality of gripper supports secured to said cylinder body with each of said gripper supports carrying a bearing, each of said bearings supporting one of said controllable grippers, and further including a plurality of two arm lever assemblies secured to said cylinder body, each of said two arm lever assemblies including a first arm and a second arm, and a cam mechanism secured to a side frame of the printing press, said first arm having a first end secured to a control spindle and a second end in contact with said cam mechanism, said second arm having a first end secured to said control spindle and a second end connected to said gripper support.

4. The cylinder of claim 2 wherein each of said grippers includes a gripper tip engageable with said edge surface of said signature and including a pivotable linear guide for each of said grippers, each said linear guide being secured to said cylinder body and receiving a push rod, said push rod being connected to said gripper, and further including a cam mechanism secured to a side frame of the printing press and a two armed lever assembly having first and second levers with first ends of said first and second levers being secured to a control spindle mounted in said cylinder body and with a second end of said first lever being in contact with said cam mechanism and with a second end of said second lever being connected to said push rod whereby each of said gripper tips is hingedly connected in a plane defined by a direction of rotation of said cylinder.

5. The cylinder of claim 2 wherein each of said signatures has longitudinal side edges and an end area at the intersection of said leading edge and said side edges and further wherein said grippers engage said signatures in said end area.

6. The cylinder of claim 2 wherein said cylinder body includes spaced end disks and further including a drive means for each of said controllable grippers, said drive means being located in said cylinder body between said end disks.

7. The cylinder of claim 2 wherein said controllable grippers are disposed along said axis of rotation and are engageable with said signature leading edge.

8. The cylinder of claim 6 wherein each of said controllable grippers has a generally L-shaped gripper tip.

9. The cylinder of claim 1 further including an elongated axially extending gripper strip secured to said plurality of clamping devices and engageable with said signature leading edge.

10. The cylinder of claim 9 wherein said cylinder body includes spaced end disks and further including a drive means for said clamping devices, said drive means being disposed between said signature and said spaced end disks.

11. A folding cylinder usable to receive and convey signatures in a folding apparatus of a web-feb rotary printing press, said folding cylinder comprising:

a cylinder body having spaced end disks and a jacket surface;

means for supporting said cylinder body for rotation about a central axis of rotation;

a plurality of controllable and retractable point spurs supported in said cylinder body and being usable to engage and to secure a leading edge of a signature to said jacket surface of said cylinder body;

controllable signature grippers supported in said cylinder body and having gripper tips which are engageable with said signature, said controllable signature grippers acting in conjunction with said point spurs to secure said leading edge of a signature to said jacket surface of said cylinder body; and means to move said gripper tips into and out of contact with said signatures during rotation of said cylinder body about said axis of rotation, said gripper tips engaging said signatures while said signatures are engaged by said point spurs, said gripper tips securing said signatures to said jacket surface during retraction of said point spurs, said gripper tips continuing to secure said signatures to said jacket surface after retraction of said point spurs.

12. A cylinder such as a folding cylinder usable to convey signatures to a subsequent device such as a transverse folding device in a web-feb rotary printing press, said cylinder comprising:

a cylinder body having an outer jacket surface and an axis of rotation;

a plurality of controllable and retractable point spurs usable to secure a leading edge of a signature to said jacket surface;

controllable grippers acting on a strip shaped area at a leading edge surface of said signatures to clamp said signatures to said jacket surface of said cylinder during the time when said point spurs are retracted, and a plurality of gripper supports secured to said cylinder body with each of said gripper supports carrying a bearing, each of said bearings supporting one of said controllable grippers, and a plurality of two arm lever assemblies secured to said cylinder body, each of said two arm lever assemblies including a first arm and a second arm, and a cam mechanism secured to a side frame of the printing press, said first arm having a first end secured to a control spindle and a second end in contact with said cam mechanism, said second arm having a first end secured to said control spindle and a second end connected to said gripper support.

13. A cylinder such as a folding cylinder usable to convey signatures to a subsequent device such as a transverse folding device in a web-fed rotary printing press, said cylinder comprising:

a cylinder body having an outer jacket surface and an axis of rotation;

a plurality of controllable and retractable point spurs usable to secure a leading edge of a signature to said jacket surface;

controllable grippers acting on a strip shaped area at a leading edge surface of said signatures to clamp said signatures to said jacket surface of said cylinder during the time when said point spurs are retracted, and a gripper tip on each said controllable gripper and engageable with said edge surface of said signature and including a pivotable linear guide for each of said grippers, each said linear guide being secured to said cylinder body and receiving a push rod, said push rod being connected to said gripper, and a cam mechanism secured to a side frame of the printing press and a two armed lever assembly having first and second levers with first ends of said first and second levers being secured to a control spindle mounted in said cylinder body and with a second end of said first lever being in contact with said cam mechanism and with a second end of said second lever being connected to said push rod whereby each of said grippers tips is hingedly connected in a plane defined by a direction of rotation of said cylinder.

* * * * *